US008827326B1

(12) United States Patent
Babij

(10) Patent No.: US 8,827,326 B1
(45) Date of Patent: Sep. 9, 2014

(54) LATCH USABLE OPTIONALLY BY ARTHRITIC AND DISABLED PERSONS

(75) Inventor: Terry Babij, Ridgeway (CA)

(73) Assignee: Berenson Corp., Buffalo, NY (US)

( * ) Notice: Subject to any disclaimer, the term of this patent is extended or adjusted under 35 U.S.C. 154(b) by 549 days.

(21) Appl. No.: 13/033,140

(22) Filed: Feb. 23, 2011

Related U.S. Application Data

(60) Provisional application No. 61/307,525, filed on Feb. 24, 2010.

(51) Int. Cl.
*E05C 1/10* (2006.01)

(52) U.S. Cl.
USPC ..... 292/175; 292/169.13; 292/169.18

(58) Field of Classification Search
USPC ..... 292/175, 169.14, 169.15, 169.17, 176, 292/149, 150, 163, 164, 169.13, 169.18
See application file for complete search history.

(56) References Cited

U.S. PATENT DOCUMENTS

| | | | | | |
|---|---|---|---|---|---|
| 1,378,622 | A * | 5/1921 | Sarbij | ..... | 292/142 |
| 1,559,423 | A * | 10/1925 | Hartzler | ..... | 292/333 |
| 1,572,077 | A * | 2/1926 | Perez | ..... | 292/169.14 |
| 1,816,259 | A * | 7/1931 | Lande | ..... | 292/169.14 |
| 2,454,672 | A * | 11/1948 | Rosenthal et al. | ..... | 292/150 |
| 4,055,361 | A * | 10/1977 | Moses | ..... | 292/359 |
| 4,226,451 | A * | 10/1980 | Gingras | ..... | 292/169.21 |
| 4,479,671 | A * | 10/1984 | Colombo | ..... | 292/169.14 |
| 5,927,769 | A * | 7/1999 | Pullen | ..... | 292/169.13 |
| 6,793,254 | B1 * | 9/2004 | Galvin | ..... | 292/163 |
| 6,942,257 | B2 | 9/2005 | Wong et al. | | |
| 7,249,791 | B2 * | 7/2007 | Johnson | ..... | 292/333 |

* cited by examiner

*Primary Examiner* — Mark Williams
(74) *Attorney, Agent, or Firm* — James C. Simmons

(57) ABSTRACT

A latch for detachably attaching a door to a jamb and convertible to an arrangement wherein the door can be opened and closed without manipulating the knob so that people with arthritis and certain disabilities may be relieved from having to manipulate the knob. In the converted arrangement, the bolt is held in a retracted position relative to the latch housing by a screw received in apertures in the housing and in the bolt. The knob is also held non-rotatably by the screw also being threadedly received in a threaded aperture in a cam to which the knob is attached.

11 Claims, 5 Drawing Sheets

LATCH USABLE OPTIONALLY BY ARTHRITIC AND DISABLED PERSONS

Priority of U.S. provisional patent application 61/307,525, filed Feb. 24, 2010, which is incorporated herein by reference, is hereby claimed.

The present invention relates generally to latching devices such as used, for example, for opening and closing kitchen cabinets.

Various latching devices are marketed by various companies such as Berenson Corporation of Buffalo, N.Y. For example, latches have been provided which have cabinet door-mounted housings which have spring-loaded tongues or bolts which are spring-biased for movement outwardly to be receivable in a notch of a fitting on a cabinet jamb to maintain a cabinet door latched or locked (connected to the jamb) in a closed position. In order to unlatch the cabinet door, a knob is turned to move the tongue or bolt, against the force of the spring, out of the notch, after which the bolt moves back outwardly.

U.S. Pat. No. 6,942,257 discloses a latch for a cabinet door or drawer for preventing access to the interior thereof. The latch includes a hook spring biased to engage a catch and that allows the door or drawer to be only slightly opened enough to allow a caregiver to reach the latch and displace it out of the way so that the door or drawer can be fully opened. When released, the latch returns to the biased position. The latch may also disengage the spring so as to be fully disabled and allow the door or drawer to be opened freely. In a latching device, the disengagement or removal of a spring to render the device inoperative to provide locking or latching may undesirably require a customer to have to open up the latch and put it back together again after the spring has been removed or rendered inoperative. Moreover, it would be difficult for the customer to replace the spring should it become lost after it is removed.

People with arthritis and certain disabilities may have difficulty manipulating the knob to unlock or unlatch the closed cabinet door from the jamb.

It is accordingly an object of the present invention to provide a latch which allows the door to be latchable or lockable in the closed position or to be easily convertible to an arrangement wherein it remains unlatched or unlocked (disconnected from the jamb), at the option of the user.

In order to provide such a latch, in accordance with the present invention, the latch is convertible in a manner such that the bolt or tongue is held in a retracted position within the housing (i.e., does not protrude or extend therefrom) whereby the door can be opened and closed without the necessity of manipulating the latch knob to lock or latch the door to or to unlock or unlatch it from the jamb.

The above and other objects, features, and advantages of the present invention will be apparent in the following detailed description of the preferred embodiment thereof when read in conjunction with the appended drawings wherein the same reference numerals denote the same or similar parts throughout the several views.

DETAILED DESCRIPTION OF THE PREFERRED EMBODIMENT

Figure 1:
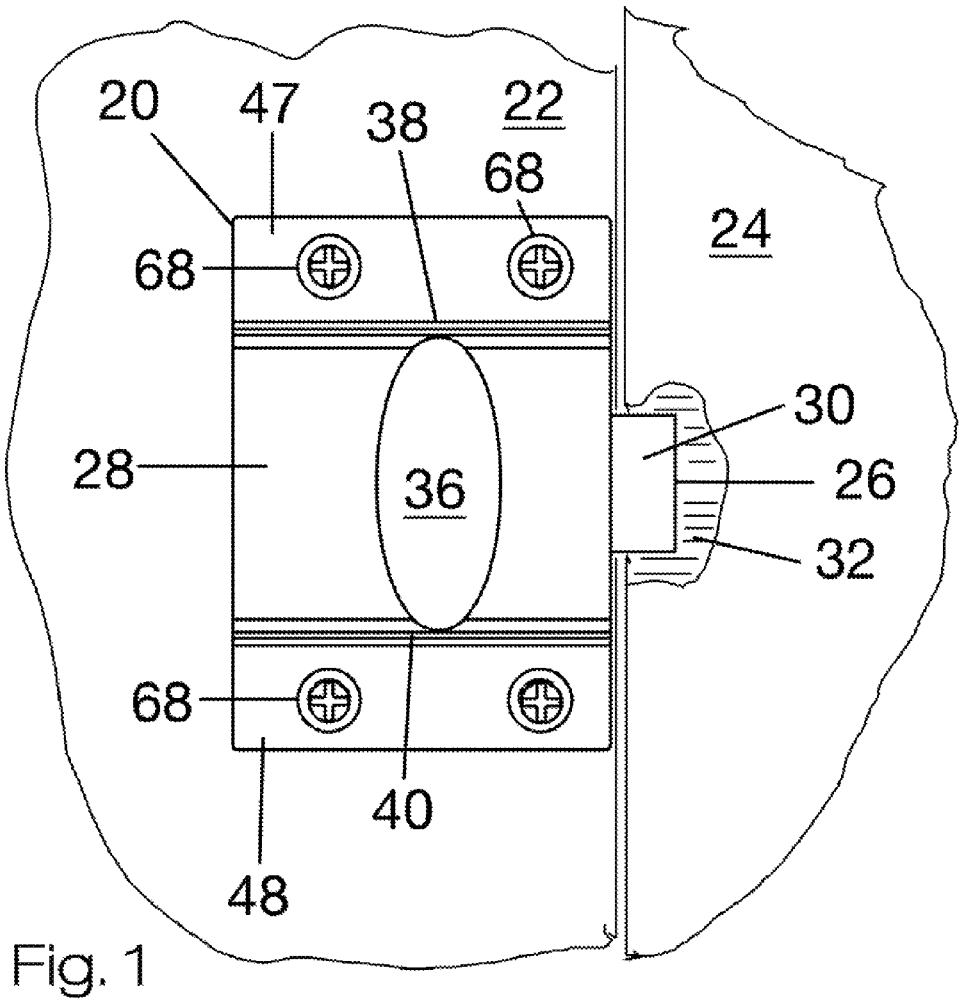
FIG. 1 is a front elevation view of a latch which embodies the present invention, illustrated attached to a cabinet.

Referring to the drawings, there is shown generally at 20 a latch for latching or locking or connecting a cabinet door 22 to a cabinet jamb 24. It should of course be understood that the latch 20 may be used for structures other than cabinets.

Figure 6:
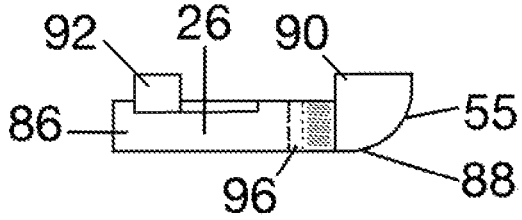
FIG. 6 is a side view of the bolt.

The latch 20 includes a housing 28 in which is received a bolt or tongue 26. The bolt 26 is movable between a retracted position wherein it is within the latch housing 28 (unlatched or retracted position, illustrated in FIGS. 8 and 10) and an extended position, illustrated in FIGS. 1, 2, 3, 7, and 9, wherein it protrudes or extends outwardly from the housing 28 to a locking or latching position. In this locking or latching position, the bolt 26 is illustrated in FIG. 1 to be received in a notch, illustrated at 30, in a fixture 32 (shown, for purposes of clarity, with a portion removed) suitably positioned on and attached to the jamb 24 to receive the bolt 26 to maintain the door 22 closed and latched (locked position). The bolt 26 is spring-biased by a spring, illustrated at 34 (FIGS. 7 and 9), to hold the bolt 26 in (bias the bolt to) the extended or locked position. A knob 36 (oblong or otherwise suitably shaped) is rotatable through, for example, a quarter turn (an eighth turn in either direction) to counter the spring force and move the bolt 26 to the retracted or open position (within the housing) so that the cabinet door 22 can be opened. The bolt 26 has a terminal jamb engaging portion 88 which has an arcuate or rounded camming surface, illustrated at 55 in FIG. 6, which allows its engagement with the jamb fixture 32 as the door 22 is moved to a closed position to push the bolt 26 into the housing 28 sufficiently so that it can be moved into the locking position as the door 22 is pushed to the fully closed position, without having to turn the knob 36, as is well known in the art. Such an operation of a latch as described in this paragraph is well known in the art.

The latch components may be made of stainless steel, bronze, or other suitable material. The housing 28 has an interior defined by upper and lower walls 38 and 40 respectively and a pair of side walls 42 and 44. A front wall 46 joins the walls 38, 40, 42, and 44, and the walls 38 and 40 flare out slightly therefrom, as seen in FIG. 1. Along the edges opposite the front wall 46, flanges 47 and 48 extend from the upper and lower walls 38 and 40 respectively. Each flange 47 and 48 has a pair of spaced apertures, illustrated at 50, for receiving screws 68 or other suitable fasteners for attaching the housing 28 to the cabinet door 22 (or the housing 28, either with or without the flanges, is otherwise suitably secured to the door 22).

Figure 4:
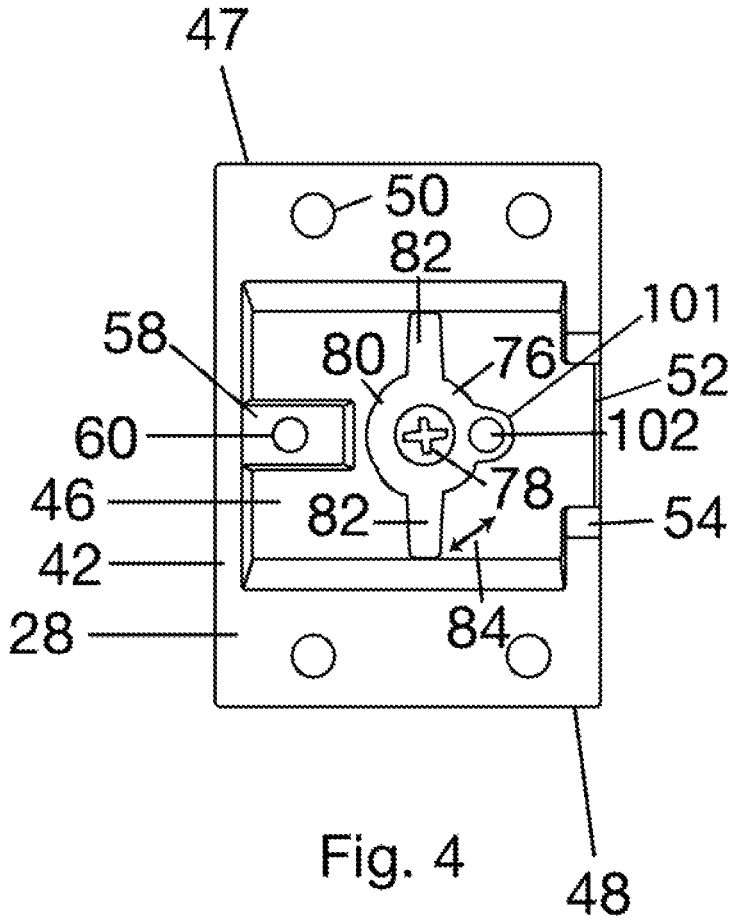
FIG. 4 is a view similar to that of FIG. 3, with a cover plate and bolt (tongue) removed.
Figure 5:
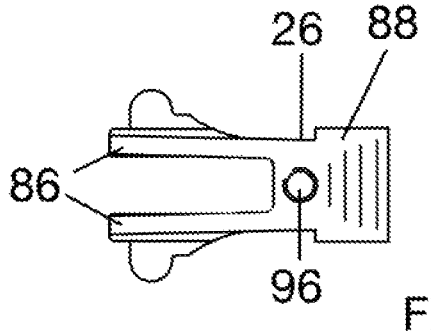
FIG. 5 is a plan view of the bolt.

The housing 28 has an opening, illustrated at 52, in side wall 44 for receiving the bolt 26. The rear edge of the side wall 44 is notched at the edges of the opening 52 to provide shoulders, illustrated at 54, upon which a rear cover plate 56 (defining a rear wall) is received and positioned. Affixed on the interior of the housing 28 to the front and side walls 46 and 42 respectively is a mounting or fixture 58 (FIG. 4) which rises from the front wall 46 to the same level therefrom as the level of the shoulders 54 and in which is a threaded aperture, illustrated at 60, normal to the front wall 46. The cover plate 56 has adjacent an end edge thereof an aperture, illustrated at 62. After the cover plate 56 is slipped into position on the shoulders 54 with its outer surface flush with the outer surfaces of the flanges 47 and 48, it is secured in position covering the rear of the housing interior by a screw 66 (FIGS. 3 and 8), which is received in cover plate aperture 62 and threadedly received in threaded mounting aperture 60.

The shank 70 for the knob 36 passes through an aperture, illustrated at 72, in the front wall 46, centrally thereof, and terminates in a portion with a squared cross-section, which is conventional in the art. The shank 70 may conventionally include a smaller diameter portion adjacent the knob 36 and an enlarged (increased diameter) stabilizing portion (not shown) spaced from the knob 36, i.e., as the shank 70 enters the housing. The shank 70 is press-fit in a similarly squared cross-section aperture centrally of a cam 76, thereby to prevent rotation of the cam 76 relative to the shank 70, as is well known. The cam 76 is further secured to the shank 70 by a screw 78 threadedly received in a threaded aperture (not shown) in the terminal end of the shank 70, the head of the screw 78 being of a size to extend beyond (overlap) the squared edges of the shank terminal portion to prevent the cam 76 from coming off the shank 70.

The cam 76 is a flat plate which lies adjacent the inner surface of the front wall 46. It has a circular portion 80 from which extends a pair of diametrically opposed arms 82. The cam 76 is rotatable, as illustrated at 84 (FIG. 4), through about a half turn (an eighth turn in either direction) by rotation of the knob 36 and/or movement of the bolt 26 as hereinafter described.

The bolt 26 includes a pair of spaced legs 86 which extend from the jamb engaging portion 88 inwardly. The portion 88 has a portion 90 (FIG. 6) which extends below (i.e., toward the front wall 46) the legs 86, and the terminal end portions of the legs similarly have portions 92 (FIG. 6) which extend below (toward the front wall 46) the legs 86. These portions 90 and 92 may be said to serve as pads which can slide along the inner surface of the front wall 46 and raise the legs 86 from the inner surface of the front wall 46 so that the legs 86 are raised from and thereby clear the cam 76.

Figure 2:
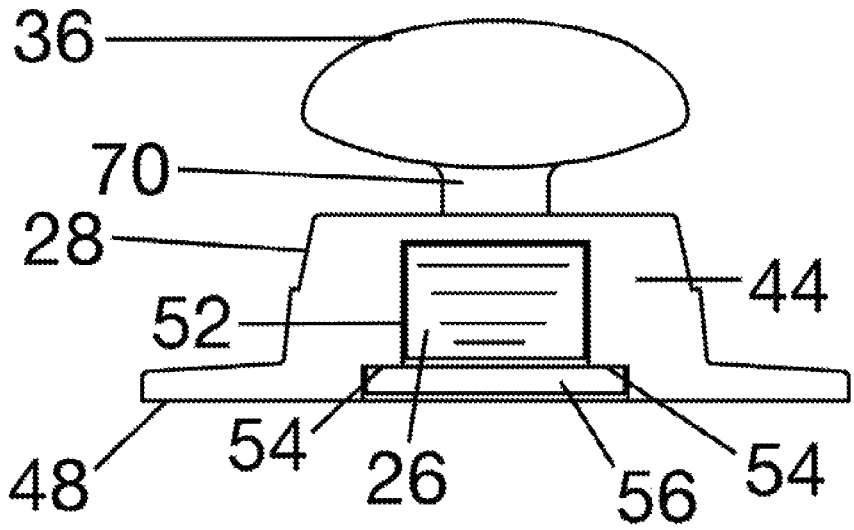
FIG. 2 is a side elevation view thereof.
Figure 3:
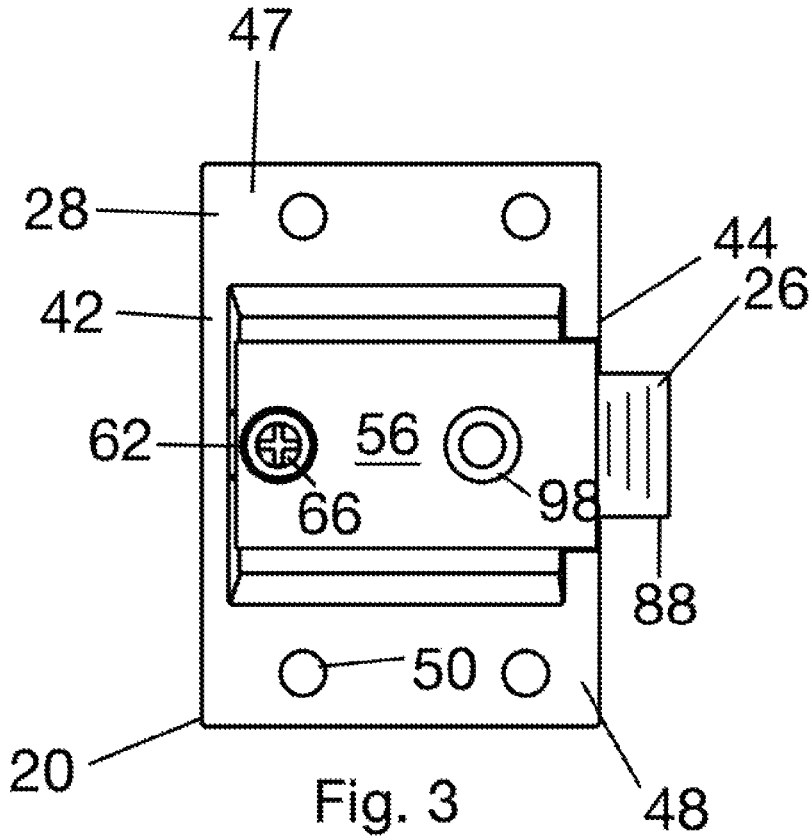
FIG. 3 is a rear elevation view thereof.

The spring 34 is of the compression-type and is received to lie between (i.e., generally parallel to) the legs 86 and to extend between the fixture 58 and the jamb engaging portion 88. The spring 34 is thus biased to urge the bolt 26 to the extended or locked position of FIGS. 1, 2, 3, 7, and 9. During the movement to this position, the pads 90 and 92 slide along the inner surface of the front wall 46 effecting movement of the cam arms 82 to the vertical position illustrated in FIG. 7 and with the knob 36 also vertically oriented as illustrated in FIGS. 1 and 2. The bolt 26 remains in this locked position until the knob 36 is rotated or until the bolt 26 is pushed inwardly by the effect of the camming surface 55 engaging the jamb fixture 32 or otherwise.

Figure 8:
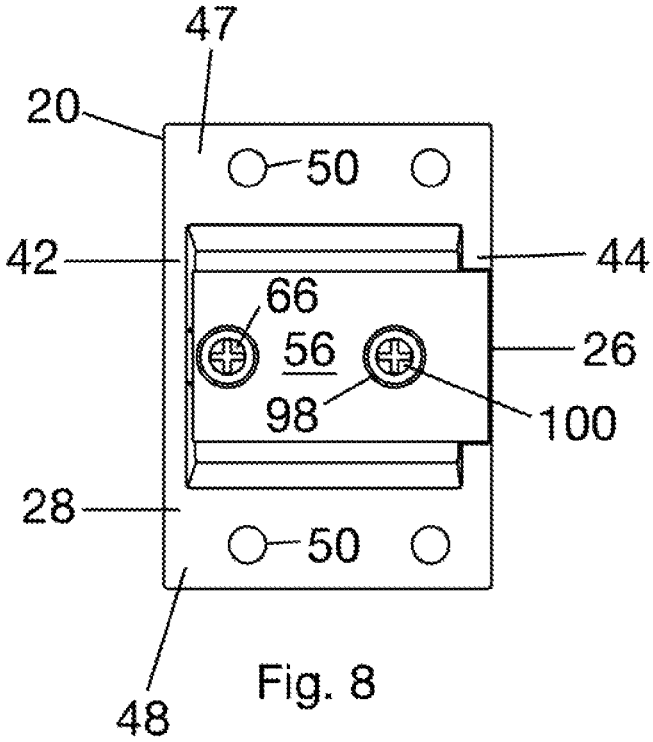
FIG. 8 is a view similar to that of FIG. 3 of the latch, with the bolt illustrated in a fixed non-latching or unlocked position.
Figure 10:
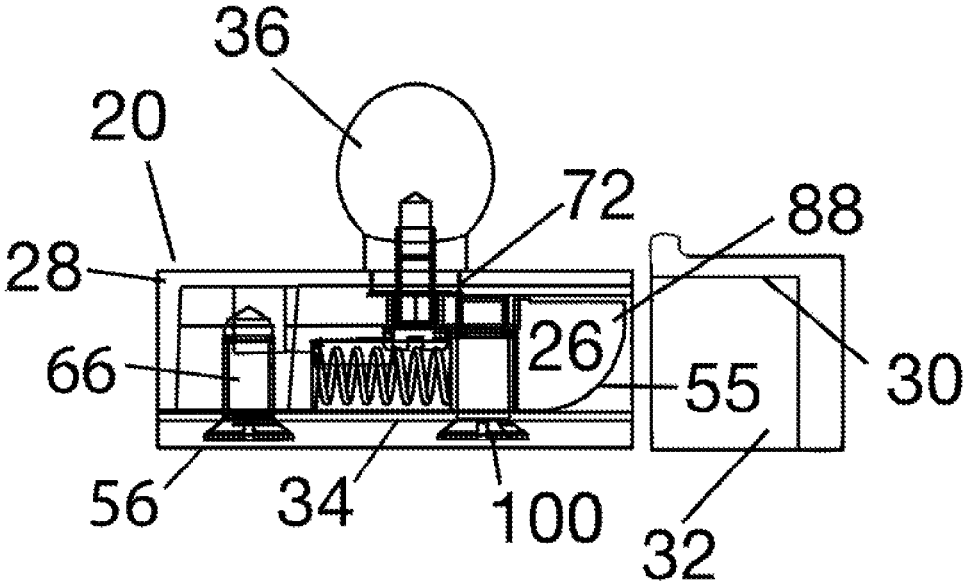
FIG. 10 is a view similar to that of FIG. 9 of the latch, with the bolt illustrated in the fixed non-latching or unlocked position of FIG. 8.

Rotation of the knob 36 by about an eighth of a turn in either direction causes a corresponding cam arm 82 to push the respective pad 92 and thence the bolt 26 toward the side wall 42 thereby moving the bolt 26 inwardly, against the pressure of spring 34, to the retracted or open position of FIGS. 8 and 10. After the knob 36 is released, the force of spring 34 will urge the bolt 26 back to the extended or locked position with the knob 36 being urged back to the vertical position of FIGS. 1 and 2.

A latch as so far described is conventional and well known in the art and can be constructed using principals commonly known to those of ordinary skill in the art to which this invention pertains. It should be understood that there may be various variants of such a latch as so far described as those of ordinary skill in the art can appreciate and construct.

The use of a latch 20 as thus far described, wherein the knob 36 must be rotated to open a cabinet door, may be difficult for persons with arthritis and persons with disabilities. In order to make the latch user friendly when in use primarily for such persons, in accordance with the present invention, the latch 20 is convertible in a manner such that it can stay open (i.e., wherein the bolt 26 is held in the retracted position in the housing 28 as illustrated in FIGS. 8 and 10), thereby allowing a person to pull a door open and to push the door to a closed position without having to turn the knob 36.

In order to provide such convertibility to the latch 20, the bolt 26 is provided with a threaded aperture, illustrated at 96, centrally of the bolt width, outwardly of the legs 86, adjacent the jamb engaging portion 88, and extending entirely through the bolt 26. The cover plate 56 has in its end portion opposite the end portion containing aperture 62 another aperture 98 which, when the cover plate is attached to the housing 28 by means of screw 66 as previously discussed and with the bolt in the housing (i.e., not protruding from the housing) as illustrated in FIGS. 8 and 10, is in alignment with aperture 96. In order to optionally retain the bolt 26 in the retracted or open position of FIGS. 8 and 10, in accordance with the present invention, a screw 100 or other suitable fastener is received in cover plate aperture 98 and threadedly received in bolt threaded aperture 96 thereby to prevent movement outwardly of the bolt to the extended or locking position of FIGS. 1, 2, 3, 7, and 9.

The cam circular portion 80 preferably has a radially increased or outwardly protruding portion 101 (FIG. 4) which faces the opening 52 or side wall 44 (spaced angularly about 90 degrees from each of the legs 82 or angularly midway between the legs) to be aligned with the bolt aperture 96 when the knob 36 is in the vertical position of FIGS. 1 and 2. Thus, to desirably position the knob 36 non-rotatably in this vertical position, the screw 100 is also received in the cam's threaded aperture 102 when it is threadedly engaged in the bolt aperture 96, thereby to keep the knob 36 from being rotated from the vertical position.

It should be understood that it may be considered unnecessary, to retain the screw 100 position, that both of the apertures 96 and 102 be threaded. In addition, if it is considered to be unnecessary to prevent the rotation of the knob 36, as above discussed, the cam portion 101 and its associated aperture 102 may be considered to be unnecessary, in which event it may be considered unnecessary for the aperture 98 to extend entirely through the bolt 26.

Figure 7:
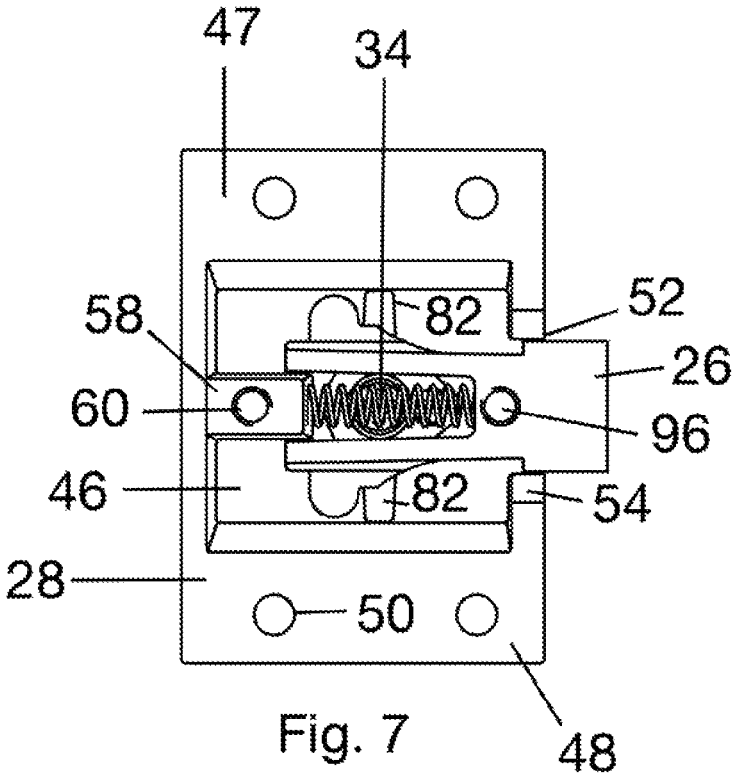
FIG. 7 is a view similar to that of FIG. 3 of the latch, with the cover plate removed and with the bolt illustrated in a latching or locked position.
Figure 9:
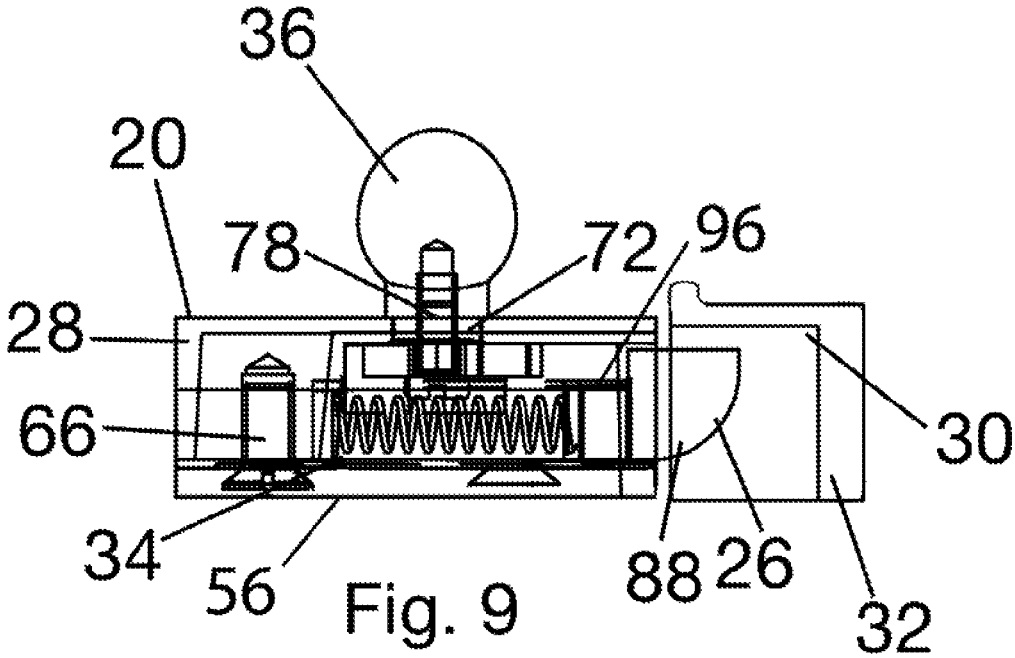
FIG. 9 is an internal partially diagrammatic horizontal view of the latch, with the bolt illustrated in the latching or locked position of FIG. 7.

In order to convert the latch 20 so that the bolt 26 can be extended to lockingly engage a jamb fixture notch 30, the screw 100 is removed, as illustrated in FIGS. 7 and 9.

In order to convert the latch 20 so that the bolt 26 is held in the retracted position and does not protrude outwardly, as illustrated in FIGS. 8 and 10, and with the knob 36 held non-rotatably in the vertical position of FIG. 1, the screw 100 is received in apertures 98 and 96 and threadedly received in cam aperture 102. It is understood that these conversions must occur with the housing unattached to the door. After a conversion has been made, then the converted housing may be attached to the door.

Thus, the present invention is provided to allow one to easily and quickly convert the latch 20 back and forth as desired between (1) its use to lockingly connect a cabinet door to a jamb (FIGS. 7 and 9), or (2) its use to allow an arthritic or disabled person to optionally have such use inactivated (FIGS. 8 and 10).

It should be understood that, while the present invention has been described in detail herein, the invention can be embodied otherwise without departing from the principles thereof, and such other embodiments are meant to come within the scope of the present invention as defined by the appended claims.

What is claimed is:

1. A device comprising a housing attachable to a door, a bolt received at least partially within said housing, a spring, and a knob, the device being convertible between a first arrangement wherein said bolt is spring-biased by said spring to move from a retracted position to an extended position for engaging a fixture attached to a jamb for latching the door to the jamb and wherein said knob is rotatable for effecting movement of said bolt to the retracted position to unlatch the door from the jamb and a second arrangement wherein said bolt is attached to said housing so that said bolt is held immovable in said retracted position, whereby the door can be opened and closed without manipulating said knob, and the device comprising means for holding said bolt immovable in said retracted position relative to said housing and further comprising means for holding said knob non-rotatably.

2. A device according to claim 1 comprising an aperture in said housing and an aperture in said bolt, wherein said bolt aperture is alignable with said housing aperture for receiving a screw in both said apertures when said bolt is in said retracted position for holding said bolt immovable in said retracted position relative to said housing.

3. A device according to claim 2 further comprising a screw receivable in both said apertures for holding said bolt immovable in said retracted position relative to said housing.

4. A device according to claim 2 wherein said bolt aperture is threaded, the device further comprising a screw receivable in said housing aperture and threadedly receivable in said bolt aperture.

5. A device comprising a housing attachable to a door, a bolt received at least partially within said housing, a spring, and a knob, the device being convertible between a first arrangement wherein said bolt is spring-biased by said spring to move from a retracted position to an extended position for engaging a fixture attached to a jamb for latching the door to the jamb and wherein said knob is rotatable for effecting movement of said bolt to the retracted position to unlatch the door from the jamb and a second arrangement wherein said bolt is attached to said housing so that said bolt is held immovable in said retracted position, whereby the door can be opened and closed without manipulating said knob, and the device comprising a cam attached to said knob for effecting movement of said bolt to the retracted position by rotation of said knob, an aperture in said housing, an aperture in said bolt, and a threaded aperture in said cam, wherein said bolt aperture, said housing aperture, and said cam aperture are alignable for receiving a screw when said bolt is in said retracted position for holding said bolt immovable in said retracted position relative to said housing and for holding said knob non-rotatably.

6. A device according to claim 5 further comprising a screw receivable in said bolt aperture, said housing aperture, and said cam aperture and threadedly receivable in said cam aperture.

7. A device comprising a housing attachable to a door, a bolt received at least partially within said housing, a spring, and a knob, the device being convertible between a first arrangement wherein said bolt is spring-biased by said spring to move from a retracted position to an extended position for engaging a fixture attached to a jamb for latching the door to the jamb and wherein said knob is rotatable for effecting movement of said bolt to the retracted position to unlatch the door from the jamb and a second arrangement wherein said bolt is attached to said housing so that said bolt is held immovable in said retracted position, whereby the door can be opened and closed without manipulating said knob, and the device comprising a cam attached to said knob for effecting movement of said bolt to the retracted position by rotation of said knob, an aperture in said housing, an aperture in said bolt, and a threaded aperture in said cam, wherein said bolt aperture, said housing aperture, and said cam aperture are alignable for receiving a screw when said bolt is in said retracted position and when said knob is oriented vertically.

8. A device according to claim 7 further comprising a screw receivable in said bolt aperture, said housing aperture, and said cam aperture and threadedly receivable in said cam aperture.

9. A device comprising a housing attachable to a door, a bolt received at least partially within said housing, a spring for biasing said bolt to move from a retracted position to an extended position for engaging a fixture attached to a jamb for latching the door to the jamb, a knob which is rotatable for effecting movement of said bolt to the retracted position to unlatch the door from the jamb, and means for holding said bolt in said retracted position immovable relative to said housing, wherein said holding means comprises an aperture in said housing and an aperture in said bolt, wherein said bolt aperture is alignable with said housing aperture for receiving a screw in both said apertures for holding said bolt immovable relative to said housing when said bolt is in said retracted position, the device further comprising means for holding said knob non-rotatably.

10. A device comprising a housing attachable to a door, a bolt received at least partially within said housing, a spring for biasing said bolt to move from a retracted position to an extended position for engaging a fixture attached to a jamb for latching the door to the jamb, a knob which is rotatable for effecting movement of said bolt to the retracted position to unlatch the door from the jamb, and means for holding said bolt in said retracted position immovable relative to said housing, wherein said holding means comprises an aperture in said housing and an aperture in said bolt, wherein said bolt aperture is alignable with said housing aperture for receiving a screw in both said apertures for holding said bolt immovable relative to said housing when said bolt is in said retracted position, and the device comprising a cam attached to said knob for effecting movement of said bolt to the retracted position by rotation of said knob and a threaded aperture in said cam, wherein said bolt aperture, said housing aperture, and said cam aperture are alignable for receiving a screw when said bolt is in said retracted position.

11. A method for converting a latch having a housing attachable to a door, a bolt received at least partially within said housing, a spring, and a knob, the device being convertible between a first arrangement wherein said bolt is spring-biased by said spring to move from a retracted position to an extended position for engaging a fixture attached to a jamb for latching the door to the jamb and wherein said knob is rotatable for effecting movement of said bolt to the retracted position to unlatch the door from the jamb and a second arrangement wherein said bolt is held immovable in said retracted position so that the door can be opened and closed without manipulating said knob, the method comprising attaching the bolt to the housing so that the bolt is held in the retracted position immovable relative to the housing, the method further comprising holding the knob non-rotatably, and the method comprising inserting a screw into an aperture in the housing and into an aperture in the bolt while the bolt is in the retracted position and threadedly engaging the screw in a threaded aperture in a cam attached to the knob thereby to hold the bolt in the retracted position immovable relative to the housing and to hold the knob non-rotatably.

* * * * *